US011692560B2

(12) United States Patent
Fukushima

(10) Patent No.: US 11,692,560 B2
(45) Date of Patent: Jul. 4, 2023

(54) FAN DEVICE

(71) Applicant: DENSO CORPORATION, Kariya (JP)

(72) Inventor: Michitaka Fukushima, Kariya (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 17/089,125

(22) Filed: Nov. 4, 2020

(65) Prior Publication Data

US 2021/0048040 A1 Feb. 18, 2021

Related U.S. Application Data

(63) Continuation of application No. PCT/JP2019/015893, filed on Apr. 12, 2019.

(30) Foreign Application Priority Data

May 8, 2018 (JP) ..... 2018-089689

(51) Int. Cl.
*F04D 29/52* (2006.01)
*F04D 25/06* (2006.01)
(Continued)

(52) U.S. Cl.
CPC ..... *F04D 29/522* (2013.01); *F04D 25/06* (2013.01); *F04D 25/08* (2013.01); *F04D 29/4206* (2013.01)

(58) Field of Classification Search
CPC ..... F04D 25/06; F04D 29/40; F04D 29/4226; F04D 29/4253; F04D 29/52; F04D 29/522; F04D 25/08; F04D 25/12; F04D 29/4206
See application file for complete search history.

(56) References Cited

U.S. PATENT DOCUMENTS 4,761,115 A * 8/1988 Hopfensperger ..... F04D 29/663 415/119
5,466,120 A 11/1995 Takeuchi et al.
(Continued)

FOREIGN PATENT DOCUMENTS

EP 1508669 A1 * 2/2005 ..... F01D 5/141
JP H06280567 A 10/1994

*Primary Examiner* — Philip E Stimpert
(74) *Attorney, Agent, or Firm* — Harness, Dickey & Pierce, P.L.C.

(57) ABSTRACT

A shroud unit has multiple stay members for supporting an electric motor, which rotates a fan unit having multiple blade members. Each of the blade members is inclined with respect to a radial direction of the fan unit in a predetermined circumferential direction. The stay members include a first stay member and multiple second stay members. Each of the second stay members is inclined with respect to the radial direction in a circumferential direction opposite to the predetermined circumferential direction. The first stay members is inclined with respect to the radial direction in the predetermined circumferential direction. The first stay member is located at a position overlapping with one of air-flow areas of a circular opening formed in the shroud unit, when viewed it in a direction along a rotational center axis of the electric motor. A flow amount of the air passing through the air-flow area of the circular opening having the first stay member is smaller than a flow amount of the air passing through another air-flow area of the circular opening having the second stay member.

3 Claims, 8 Drawing Sheets

(51) Int. Cl.
*F04D 25/08* (2006.01)
*F04D 29/42* (2006.01)

(56) References Cited

U.S. PATENT DOCUMENTS

| | | | | |
|---|---|---|---|---|
| 5,616,004 | A * | 4/1997 | Alizadeh | F04D 29/384 415/119 |
| 2016/0363132 | A1* | 12/2016 | Havel | F04D 25/06 |
| 2018/0094634 | A1* | 4/2018 | Morohashi | F04D 29/325 |

* cited by examiner

FAN DEVICE

CROSS REFERENCE TO RELATED APPLICATION

The present application is a continuation application of International Patent Application No. PCT/JP2019/015893 filed on Apr. 12, 2019, which designates the U.S. and claims the benefit of priority from Japanese Patent Application No. 2018-089689 filed on May 8, 2018. The entire disclosure of all of the above applications are incorporated herein by reference.

FIELD OF TECHNOLOGY

The present disclosure relates to a fan device for sending out air.

BACKGROUND

A fan device is installed in an automotive vehicle for sending out air so that the air passes through a heat exchanger, such as, a radiator and so on. One of the fan devices known in the art includes a fan having multiple fan blades, an electric motor for rotating the fan and so on. The electric motor is supported in the fan device by multiple stay members. Each of the fan blades and each of the stay members are formed in such a way that it extends in a radial-outward direction of the fan. Therefore, when viewed them in a direction along a flow direction of the air, the fan blade and the stay member are arranged in such a way that they overlap with each other.

Air pressure periodically fluctuates in a space between the fan blade and the stay member, when the fan is rotated. Therefore, noise is generated due to the pressure fluctuation, when the fan device is operated to send out the air.

In one of the fan devices known in the art, each of the stay members is not extending in the radial direction of the fan, that is, a direction extending from a rotational center axis of the fan and in a direction perpendicular to the rotational center axis, but each of the stay members is inclined with respect to the radial direction in a circumferential direction. More exactly, each of the stay members is inclined in the circumferential direction opposite to an inclined direction of the fan blade.

In the above structure, an area at which the fan blade and the stay member overlap with each other becomes smaller, when compared with a case that the stay members are inclined in the same circumferential direction to the inclined direction of the fan blades. An amplitude of the pressure fluctuation generated by the rotation of the fan can be decreased. It is therefore possible to decrease a noise level of the fan device.

It is necessary to connect a power supply line, a signal line and so on to the electric motor of the fan device. Electric power is supplied to the electric motor via the power supply line. A signal for indicating an operating condition of the electric motor, such as, a rotational speed or the like, is outputted via the signal line. In one of the fan devices known in the art, connectors for those power supply line and the signal line are directly connected to the electric motor. It is necessary in the fan device of the above structure to locate the stay members at such positions that an interference between the connectors and the stay members is avoided. In a case that all of the stay members are inclined in the same circumferential direction under the circumstances having the above limitation, a distance between the neighboring stay members between which the connectors are provided may become too large and it may become difficult to stably support the electric motor.

SUMMARY OF THE DISCLOSURE

It is an object of the present disclosure to provide a fan device, according to which noise level can be decreased and an electric motor can be stably supported even in a case that a connector is directly connected to the electric motor.

BRIEF DESCRIPTION OF THE DRAWINGS

The above and other objects, features and advantages of the present disclosure will become more apparent from the following detailed description made with reference to the accompanying drawings. In the drawings.

DETAILED DESCRIPTION OF EMBODIMENTS

Figure 1:
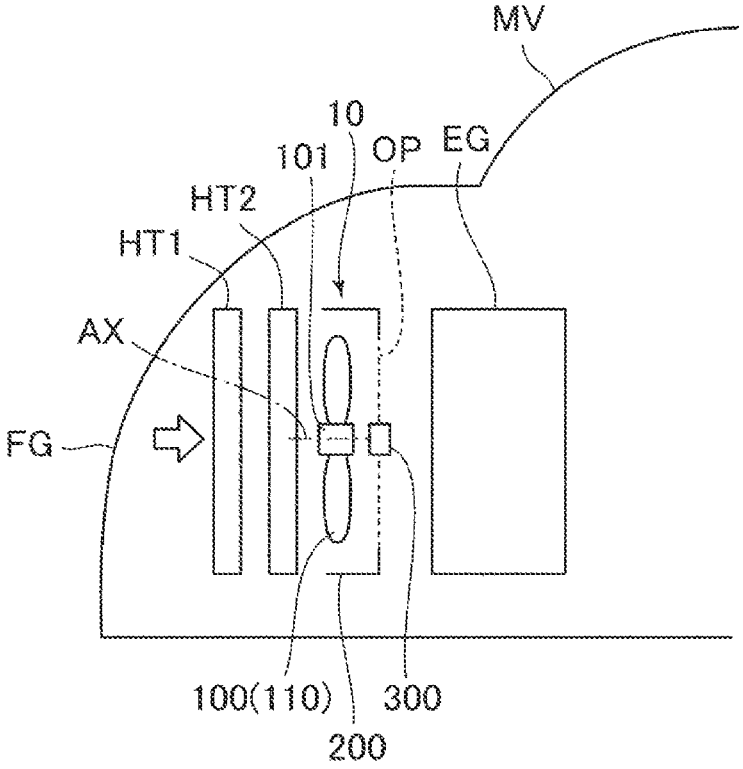
FIG. 1 is a schematic view showing a fan device according to a first embodiment of the present disclosure and a structure of an automotive vehicle in which the fan device is mounted.

Hereinafter, multiple embodiments of the present disclosure will be explained with reference to the drawings. The same reference numerals are given to the same or similar structures and/or portions throughout the multiple embodiments and explanation thereof will be omitted.

First Embodiment

A fan device 10 of a first embodiment of the present disclosure will be explained hereinafter. The fan device 10 of the present embodiment is a device mounted in an automotive vehicle MV, as shown in FIG. 1. The fan device 10 is such a device for sending out air through a condenser HT1.

At first, a structure of the automotive vehicle MV will be explained. The automotive vehicle MV includes an internal combustion engine EG (hereinafter, the engine EG), the condenser HT1 and a radiator HT2, in addition to the fan device 10. The engine EG is composed of a gasoline engine for producing a driving power for the automotive vehicle MV. Each of the fan device 10, the condenser HT1 and the radiator HT2 is located at a position in front of the engine EG in an inside space of the automotive vehicle MV.

The condenser HT1 is one of components for a refrigerating cycle, which form an air-conditioning apparatus for the automotive vehicle MV. The condenser HT1 is a heat exchanger for condensing refrigerant of a gas phase through heat exchange between the refrigerant and the air. Heat contained in the refrigerant is radiated to the air. The air, which is going to be heat exchanged with the refrigerant in the condenser HT1, is introduced through a front grill FG provided at a front side of the automotive vehicle MV. In FIG. 1, a flow of the air, which flows from the front grill FG to the condenser HT1, is indicated by an arrow.

The radiator HT2 is a heat exchanger, which cools down engine cooling water through heat exchange between the engine cooling water and the air. The engine cooling water is circulated in a cooling water circuit for the engine EG. The radiator HT2 is located at a position, which is a downstream side of the condenser HT1 in a flow direction of the air, that is, at a rear side position in an engine compartment of the automotive vehicle MV. The air, which is going to be heat exchanged with the engine cooling water in the radiator HT2, is the air introduced from the front grill FG, that is, the air having passed through the condenser HT1.

The fan device 10 of the present embodiment is located at a position, which is a downstream side of the radiator HT2 in the air flow direction but which is an upstream side of the engine EG. The fan device 10 sends out the air in a direction from the front side to the rear side of the automotive vehicle MV to thereby generate the flow of the air, which passes through the condenser HT1 and the radiator HT2.

Figure 2:
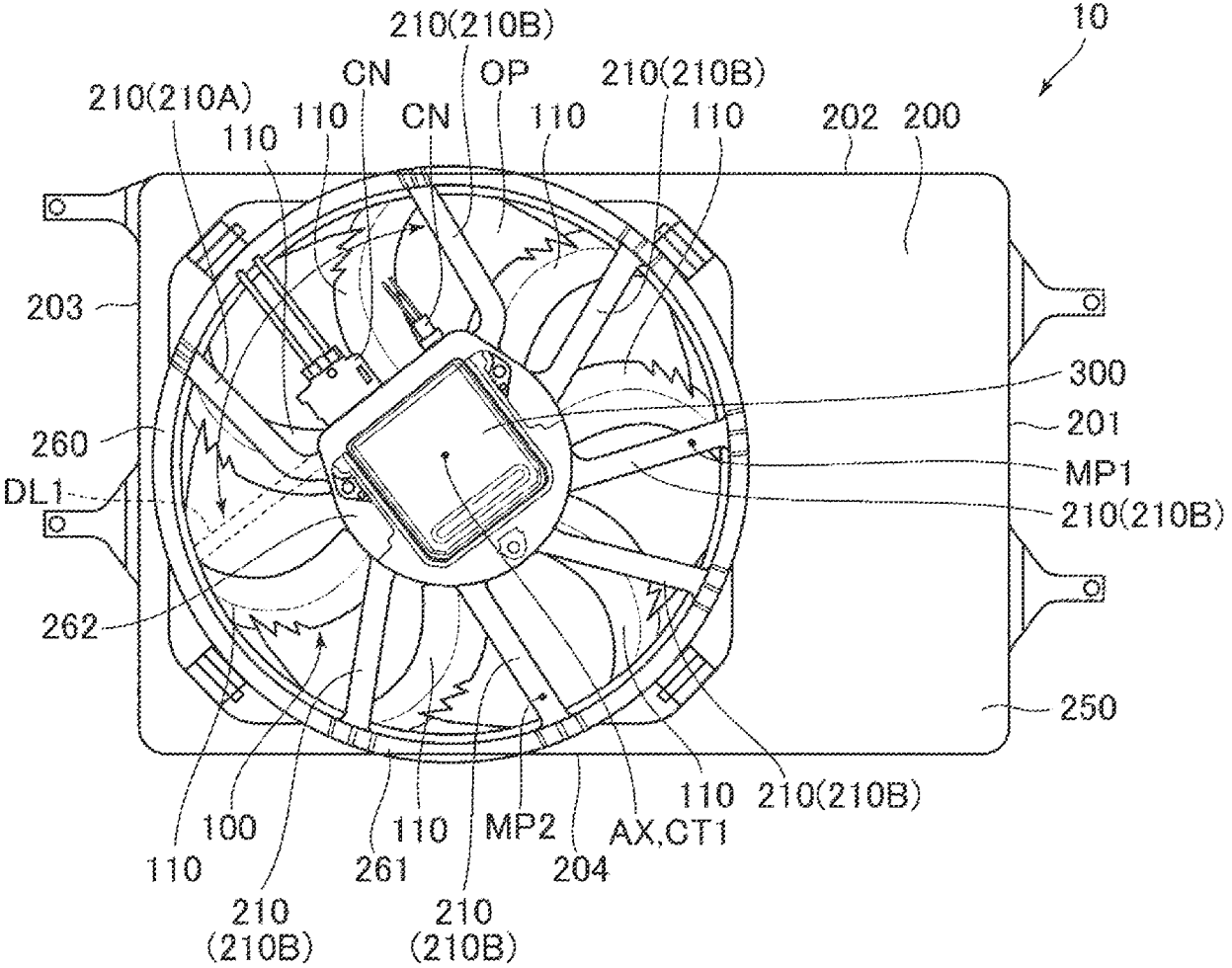
FIG. 2 is a schematic back-side view showing the fan device of the first embodiment.

A structure of the fan device 10 will be explained with reference to FIGS. 1 and 2. FIG. 2 is a schematic view of the fan device 10, when viewed it from the rear side of the automotive vehicle MV. The fan device 10 includes a fan unit 100, a shroud unit 200 and an electric motor 300.

The fan unit 100 is a component for generating the air flow when it is rotated. The fan unit 100 includes a hub portion 101 and multiple blade members 110. The hub portion 101 is a portion, which is formed in an almost cylindrical shape. The hub portion 101 is arranged in such a way that a center axis of the hub portion 101 coincides with a longitudinal direction of the automotive vehicle MV. The center axis of the hub portion 101 is a rotational center axis AX of the fan unit 100.

The blade member 110 is a portion, which works as a wing for sending out the air. The fan device 10 has the multiple blade members 110. In each of the blade members 110, a base portion is connected to an outer peripheral side surface of the hub portion 101. The multiple blade members 110 are arranged in a rotational direction of the fan unit 100. Each of the blade members 110 is formed in such a way that it extends from the outer peripheral side surface of the hub portion 101 in a radial outward direction. The rotational direction of the fan unit 100 corresponds to an anti-clockwise direction in FIG. 2.

The shroud unit 200 includes a plate-shaped member, which is so formed as to cover the fan unit 100 from a rear side thereof. A circular opening OP is formed in the shroud unit 200 at a position, which overlaps with the fan unit 100 in the longitudinal direction of the automotive direction when viewed it in the direction along the rotational center axis AX. The air passes through the circular opening OP. An opening center CT1 of the circular opening OP coincides with a point on the rotational center axis AX.

A configuration of the shroud unit 200 is almost a rectangular shape, as shown in FIG. 2, when viewed it in the direction along the rotational center axis AX. The rectangular shape of the shroud unit 200 is almost equal to a rectangular shape of the condenser HT1 and the radiator HT2, each of which is located at the upstream side of the fan device 10. In FIG. 2, each side of the rectangular shape, that is, each of outer peripheral ends of the shroud unit 200 is respectively indicated by reference numerals 201, 202, 203 and 204. Hereinafter, a right-hand side of the rectangular shape is referred to as a right-hand side portion 201. In a similar manner, an upper side of the rectangular shape is referred to as an upper side portion 202. A left-hand side of the rectangular shape is referred to as a left-hand side portion 203. A lower side of the rectangular shape is referred to as a lower side portion 204.

The opening center CT1 of the circular opening OP is located at a position, which is closer to the left-hand side portion 203 than a shroud center CT2 (FIG. 5) of the shroud unit 200, when viewed them in the direction along the rotational center axis AX. A height of the opening center CT1 in an up-down direction is almost equal to a height of the shroud center CT2.

A side wall extends from each of the side portions 201 to 204 of the shroud unit 200 in the front direction of the automotive vehicle MV, as shown in FIG. 1. Therefore, it is avoided by the shroud that the air not passing through the condenser HT1 and the radiator HT2 is drawn into the fan unit 100.

In the present embodiment, the shroud unit 200 is composed of a main body portion 250 and a motor supporting portion 260. The main body portion 250 is a plate-shaped member, which forms almost an entire portion of the main body portion 250 and which covers the fan unit 100 from the rear side thereof. The motor supporting portion 260 is a portion, which is a part of the main body portion 250 and which is connected to an outer periphery of the circular opening OP. As explained below, the motor supporting portion 260 supports the electric motor 300.

The motor supporting portion 260 includes a ring member 261, a motor supporting plate member 262 and multiple stay members 210. The ring member 261 is a ring-shaped element, which is located at the outer periphery of the circular opening OP. An inner diameter of the ring member 261 is almost equal to an inner diameter of the circular opening OP.

The motor supporting plate member 262 is a plate-shaped element for supporting the electric motor 300. A through-hole is formed in the motor supporting plate member 262 in such a way that the through-hole passes through the motor supporting plate member 262 in the longitudinal direction of the automotive vehicle MV. The electric motor 300 is firmly fixed to the motor supporting plate member 262 in a condition that a part of the electric motor 300 is inserted into the through-hole formed in the motor supporting plate member 262.

Each of the stay members 210 is a strut element, which is formed to connect the ring member 261 to the motor supporting plate member 262. The motor supporting portion 260 has the multiple stay members 210. In each of the stay members 210, one end thereof is connected to the ring member 261, while the other end is connected to the motor supporting plate member 262. Therefore, the stay member 210 is the strut element, which extends from the outer periphery of the circular opening OP to the electric motor 300 to support the electric motor 300.

In the present embodiment, the shroud unit 200 is composed of the multiple independent components including the main body portion 250 and the motor supporting portion 260. However, the shroud unit 200 may be formed as one integral unit.

The electric motor 300 is an electric rotating machine, which rotates the fan unit 100 around the rotational center axis AX. The electric motor 300 is located at a position, which is on the downstream side of the fan unit 100 and supported by the shroud unit 200 at the motor supporting plate member 262.

Two connectors CN are attached to and electrically connected to a side surface of the electric motor 300. A power supply line is connected to one of the connectors CN to supply an electric power to the electric motor 300 for driving the same. A signal line is connected to the other one of the connectors CN for outputting to an outside a signal indicating an operating condition of the electric motor 300, such as, a rotational speed of the electric motor 300 and so on. Each of the connectors CN is directly connected to the side surface of the electric motor 300. A number of the connectors CN to be attached to the side surface of the electric motor 300 is not limited to two, but may be one or more than two.

A wire is connected to each of the connectors CN at its one end. The other end of the wire is connected to a control unit (not shown). An operation of the electric motor 300, for example, the rotational speed of the fan unit 100, is controlled by the control unit.

Figure 3:
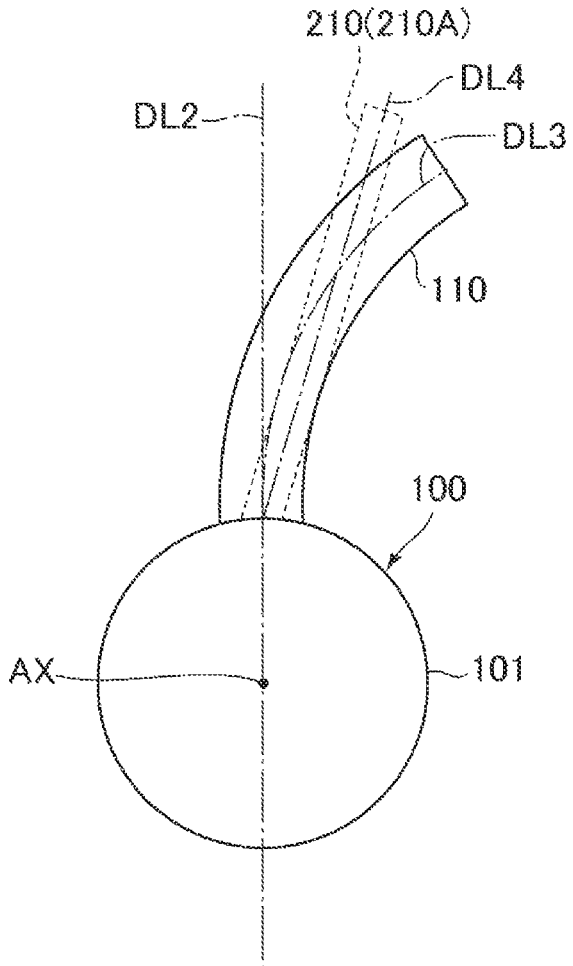
FIG. 3 is a schematic plan view showing a configuration of a blade member and a stay member, wherein the stay member is inclined in the same circumferential direction to that of the blade member.
Figure 4:
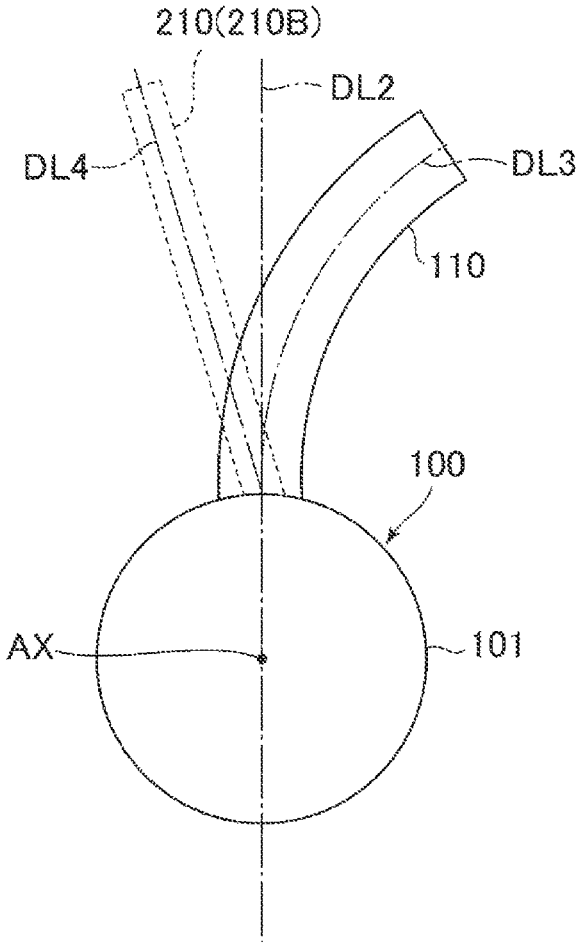
FIG. 4 is a schematic plan view showing and explaining the configuration of the blade member and the stay member, wherein the stay member is inclined in the circumferential direction opposite to the inclined direction of the blade member.

Configurations of the blade members 110 and the stay members 210 will be explained with reference to FIGS. 3 and 4. Each of FIGS. 3 and 4 schematically shows the configurations of the blade member 110 and its related portions, when viewed them from the rear side of the fan device 10 along the rotational center axis AX. In each of FIGS. 3 and 4, only one blade member 110 is shown and the remaining blade members 110 are omitted. In a similar manner, only one stay member 210 is shown in each of FIGS. 3 and 4 and the remaining stay members 210 are omitted.

A one-dot-chain line DL2 in FIG. 3 and other drawings is a line, which passes through a most-radial-inside portion of the blade member 110 (that is, an end of the blade member 110 on the side to the hub portion 101) and which is perpendicular to the rotational center axis AX. A one-dot-chain line DL3 in FIG. 3 and other drawings is a line, which passes through a center of the blade member 110 in its width direction. The width direction of the blade member 110 can be also referred to a circumferential direction of the fan unit 100. The one-dot-chain line DL2 and the one-dot-chain line DL3 overlap with each other at a position corresponding to the most-radial-inside portion of the blade member 110 (closest to the hub portion 101). A direction extending along the one-dot-chain line DL2 from the rotational center axis AX to a radial outside end is also referred to as a radial direction of the blade member 110.

The radial direction of the blade member 110 corresponds a direction, which passes through a base portion of the blade member 110 and which is perpendicular to the rotational center axis AX. A situation that the blade member 110 is inclined with respect to the radial direction of the blade member 110 is also referred to that the blade member 110 is inclined with respect to the radial direction.

As shown in FIGS. 3 and 4, the blade member 110 does not straightly extend in the radial direction but the blade member 110 is inclined with respect to the radial direction in one of the circumferential directions, for example, in a right-hand direction. In the fan unit 100, each of the blade members 110 is inclined in the same circumferential direction.

A radial direction for the stay member 210 is defined in the same manner to that of the blade member 110. In the condition shown in FIG. 3 and the other drawings, the one-dot-chain line DL2 passes through the most-radial-inside portion of the blade member 110, that is, the end of the blade member 110 closest to the hub portion 101 and the one-dot-chain line DL2 is perpendicular to the rotational center axis AX. A one-dot-chain line DL 4 shown in FIG. 3 is a line, which passes through a center of the stay member 120 in its width direction. The one-dot-chain line DL2 and the one-dot-chain line DL4 overlap with each other at the position corresponding to the most-radial-inside portion of the stay member 210 (closest to the hub portion 101). The direction extending along the one-dot-chain line DL2 from the rotational center axis AX to the radial outside end is also referred to as the radial direction of the stay member 210.

The radial direction of the stay member 210 corresponds a direction, which passes through a base portion of the stay member 210 and which is perpendicular to the rotational center axis AX. A situation that the stay member 210 is inclined with respect to the radial direction of the stay member 210 is also referred to that the stay member 210 is inclined with respect to the radial direction.

In a specific blade member 110 and a specific stay member 210, the radial direction of the blade member 110 differs from the radial direction of the stay member 210 depending on a rotational position of the blade member 110. In FIGS. 3 and 4, each of the blade member 110 and the stay member 210 is located at such a position that each of the radial direction of the blade member 110 and the radial direction of the stay member 210 coincides with the one-dot-chain line DL2.

In the present embodiment, each of the stay members 210 is not always inclined with respect to the radial direction in the same circumferential direction. As shown in FIGS. 2, 3 and 4, the multiple stay members 210 includes a first stay member 210A, which is inclined with respect to the radial direction in the right-hand direction (FIG. 3), that is, in the same circumferential direction to that of the blade member 110, and a second stay member 210B, which is inclined with respect to the radial direction in a left-hand direction (FIG. 4), that is, in the opposite circumferential direction to that of the blade member 110. In the present embodiment, the multiple stay members 210 includes one first stay member 210A and the remaining six stay members 210 are the second stay members 2108. In each of the second stay members 2108, the second stay member 2108 is inclined with respect to the radial direction in the circumferential direction opposite to the inclined direction of the blade member 110, that is, in the left-hand direction with respect to the radial direction.

When the blade member 110 is rotated, a positive pressure is generated in an area adjacent to a blade surface of the blade member 110 on a forward side of the rotational direction, while a negative pressure is generated in an area adjacent to the blade surface of the blade member 110 on a backward side of the rotational direction. A pressure fluctuation is generated in a space between the blade member 110 and the stay member 210 in accordance with the rotation of the fan unit 100. Noise is thereby generated by such pressure fluctuation. The space between the blade member 110 and the stay member 210 corresponds to such a space formed at an upstream side of the stay member 210.

When an overlapping area between the blade member 110 and the stay member 210 becomes larger, the pressure fluctuation is correspondingly increased. The noise generated by the pressure fluctuation is thereby increased. A noise level during the operation of the fan device 10 is influenced by the inclined direction of the stay member 210.

In the case that the stay member 210 is inclined with respect to the radial direction in the same circumferential direction to that of the blade member 110, like the first stay member 210A in FIG. 3, the overlapping area between the blade member 110 and the stay member 210 (the first stay member 210A) becomes larger. Therefore, the pressure fluctuation in the space between them becomes larger. The noise becomes correspondingly larger.

On the other hand, in the case that the stay member 210 is inclined with respect to the radial direction in the opposite circumferential direction to that of the blade member 110, like the second stay member 210B in FIG. 4, the overlapping area between the blade member 110 and the stay member 210 (the second stay member 210B) becomes smaller. Therefore, the pressure fluctuation in the space between them becomes smaller. The noise becomes correspondingly smaller.

Based on the above facts, it would seem to be more preferable not to provide the first stay members 210A shown in FIG. 3 but to form all of the stay members 210 with the second stay members 210B shown in FIG. 4, in view of reducing the noise to be generated during the operation of the fan device 10.

Namely, it would seem to be better to change the configuration of the first stay member 210A shown in FIG. 2 to a configuration indicated by a dotted line DL1 in FIG. 2, so that all of the stay members 210 are formed with the second stay members 210B. However, in such a case, a distance between the neighboring two stay members 210 between which the connectors CN are interposed, in other words, a circumferential distance indicated by an arrow in FIG. 2, becomes larger, in order to avoid an interference between the connectors CN and the stay members 210. As a result, it would become difficult to stably support the electric motor 300 by such a stay structure having the stay member 210 indicated by the dotted line DL1.

It is, therefore, necessary to make one or some of the stay members 210, which is/are located at a position close to the connectors CN, with the first stay member(s) 210A like the present embodiment, in order to avoid the interference between the connectors CN and the stay members 210 and to make the circumferential distance between the neighboring stay members 210 smaller.

In the present embodiment, as shown in FIG. 2, one of the stay members 210 is made of the first stay member 210A and the generation of the noise is suppressed by selecting a most suitable position for the first stay member 210A. More exactly, the first stay member 210A is located at such a position, which overlaps with a small flow-amount area of the circular opening OP, when viewed them in the direction along the rotational center axis AX. The small flow-amount area corresponds to a part of an air-flow area of the circular opening OP, at which an amount of the air flow passing through the circular opening OP becomes smaller compared with other parts of the air-flow area of the circular opening OP. The small flow-amount area will be explained below with reference to FIG. 5.

Figure 5:
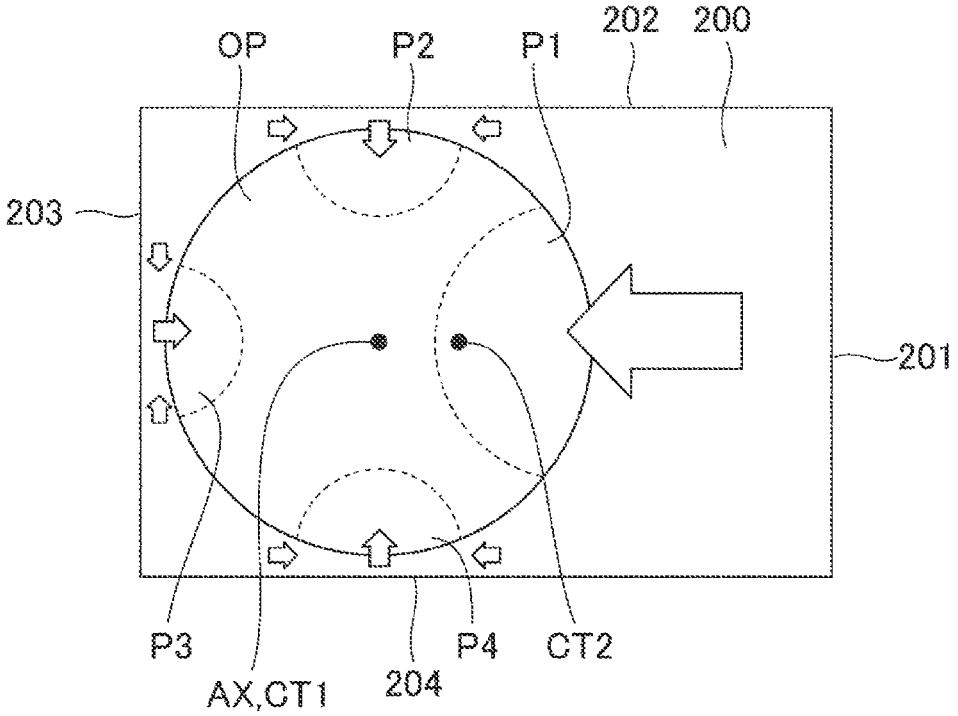
FIG. 5 is a schematic view showing a shroud unit and explaining flows of air flowing into a circular opening of the shroud unit.

FIG. 5 schematically shows the shroud unit 200, when viewed it in the direction along the rotational center axis AX. In FIG. 5, the motor supporting portion 260 including the stay members 210 is omitted.

In FIG. 5, each of arrows shows a flow direction of the air, which flows along the surface of the shroud unit 200. The air is drawn by the fan unit 100 from the side of the radiator HT2 and flows along the surface of the shroud unit 200 in the direction to the circular opening OP. A size of the respective arrow indicates a volume of the flow amount of the air at the respective points.

In the present embodiment, the opening center CT1 of the circular opening OP is located at the position, which is closer to the left-hand side portion 203 than the shroud center CT2 of the shroud unit 200. An area of a right-hand part of the shroud unit 200, which is an area between the circular opening OP and the right-hand side portion 201 (that is an area on a plane perpendicular to the air flow direction, namely perpendicular to the longitudinal direction of the automotive vehicle), is larger than an area of another part of the shroud unit 200, which is an area between the circular opening OP and the left-hand side portion 203 (that is an area on the plane perpendicular to the air flow direction along the vehicle longitudinal direction). A distance between the outer periphery of the circular opening OP and the left-hand side portion 203, a distance between the outer periphery of the circular opening OP and the upper side portion 202 and a distance between the outer periphery of the circular opening OP and the lower side portion 204 are almost equal to one another.

Therefore, a relatively large amount of the air, which is guided by the right-hand part of the shroud unit 200 having the larger area, flows into an air-flow area P1 of a right-hand part of the circular opening OP adjacent to the right-hand side portion 201. On the other hand, only a small amount of the air flows into an air-flow area P3 of a left-hand part of the circular opening OP adjacent to the left-hand side portion 203. In the present embodiment, the air-flow area P3 shown in FIG. 5 corresponds to the small flow-amount area.

A flow amount of the air flowing into an air-flow area P2 of the circular opening OP adjacent to the upper side portion 202 as well as a flow amount of the air flowing into an air-flow area P4 of the circular opening OP adjacent to the lower side portion 204 is almost equal to the flow amount of the air flowing into the air-flow area P3, which is the small flow-amount area. In the present embodiment, the flow amount of the air is an amount of the air, which passes through a unit area of each air-flow areas P1 to P4 of the circular opening OP in the direction along the rotational center axis AX, when viewed it in the direction along the rotational center axis AX.

In the present embodiment, the first stay member 210A is located at a position, which overlaps with the small flow-amount area, that is, the air-flow area P3 of the circular opening OP, when viewed it in the direction along the rotational center axis AX. An advantage thereof will be explained with reference to FIGS. 6A and 6B.

Figure 6A:
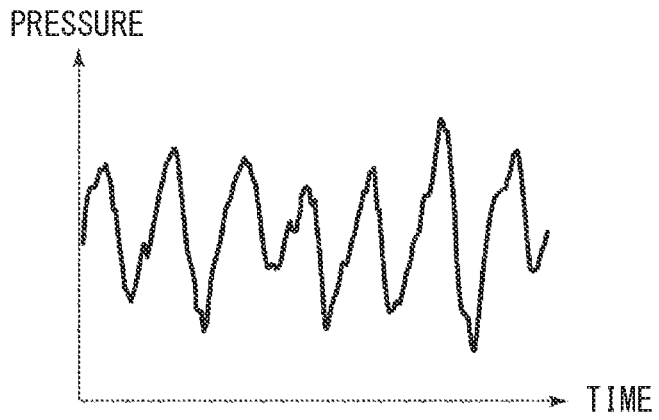
FIGS. 6A and 6B are graphs, each of which shows pressure fluctuation in a space between the blade member and the stay member.

FIG. 6A is a graph showing pressure fluctuation at a first measuring point MP1 in FIG. 2, which is a space between the stay member 210 and the fan unit 100. In addition, the first measuring point MP1 is a point located inside of the air-flow area P1 in FIG. 5. As explained above, since the relatively large amount of the air flows through the air-flow area P1, an amplitude of the pressure fluctuation becomes larger than that in the other air-flow areas P2 to P4 during the operation of the fan device 10.

Figure 6B:
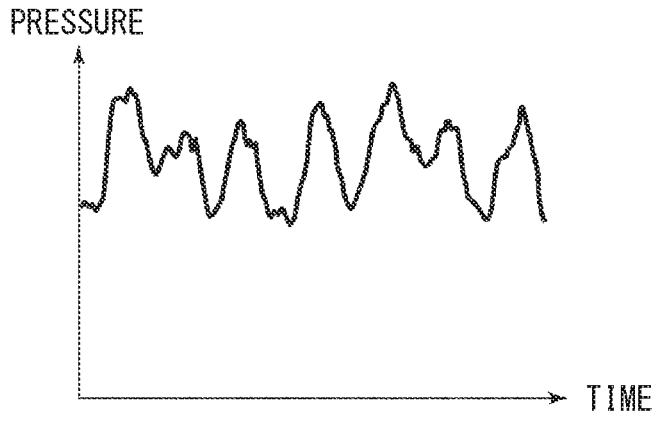

FIG. 6B is a graph showing pressure fluctuation at a second measuring point MP2 in FIG. 2, which is a space between the stay member 210 and the fan unit 100. In addition, the second measuring point MP2 is a point located inside of the air-flow area P4 in FIG. 5. As explained above, only the relatively small amount of the air flows through the air-flow area P4 and the air-flow amount is almost equal to that of the air flowing into the small flow-amount area, that is, the air-flow area P3. Since the flow amount of the air in the air-flow area P4 is small, an amplitude of the pressure fluctuation in the air-flow area P4 during the operation of the fan device 10 is smaller than that of the pressure fluctuation in the air-flow area P1 shown in FIG. 6A.

Each of the measuring points MP1 and MP2 is located at the position, which overlaps with the second stay member 210B. In a case that all of the stay members 210 has the same configurations with one another, the amplitude of the pressure fluctuation in each of the air-flow areas P1 to P4 of the circular opening OP is increased depending on the flow amount of the air passing through the respective air-flow area.

The flow amount of the air, which flows through the air-flow area P3, that is, the air-flow area adjacent to the first stay member 210A located at the position overlapping the small flow-amount area, is almost equal to the flow amount of the air, which flows through the air-flow area P4. The amplitude of the pressure fluctuation in the air-flow area P3 becomes larger due to the inclined direction of the first stay member 210A. However, such an increase of the amplitude of the pressure fluctuation is suppressed in such a way that the amplitude of the pressure fluctuation becomes larger than that of FIG. 6B by only a small amount.

Namely, in the present embodiment, the first stay member 210A (which generally increases the noise level) is located at the position, which overlaps with the small flow-amount area (equal to the air-flow area P3). It is thereby possible to suppress the increase of the amplitude of the pressure fluctuation to be generated in the air-flow area adjacent to the first stay member 210A to a small amount, so that the amplitude of the pressure fluctuation becomes almost the same level to the amplitude of the pressure fluctuation generated in the air-flow area adjacent to the second stay member 210B. In other words, the amplitude of the pressure fluctuation generated in the air-flow area P3 adjacent to the first stay member 210A can be made almost equal to the amplitude of the pressure fluctuation generated in the air-flow area P4 adjacent to the second stay member 210B shown in FIG. 6B. As a result, it is possible to reduce the noise level during the operation of the fan device 10, while the fan device 10 has such a structure according to which the connectors CN can be directly connected to the electric motor 300.

In the present embodiment, an entire portion of the first stay member 210A may be located at the position overlapping with the small flow-amount area (the air-flow area P3). Alternatively, the first stay member 210A may be located at the position in such a way that a part of the first stay member 210A overlaps with the small flow-amount area (the air-flow area P3).

In the present embodiment, the opening center CT1 of the circular opening OP is located at the position, which is off-center from the shroud center CT2 of the shroud unit 220 in the predetermined direction (in the left-hand side direction of the automotive vehicle MV), when viewed them in the direction along the rotational center axis AX. As a result, one of the air-flow areas (P3 in FIG. 5) of the circular opening OP in the predetermined direction is formed as the small flow-amount area. Since the first stay member 210A is provided at the position, which overlaps with the small flow-amount area, it is possible to effectively suppress the generation of the noise.

The small flow-amount area of the present embodiment corresponds to such an air-flow area of the circular opening OP, at which the flow amount of the air is minimized. The present embodiment may be modified in such a way that the circular opening OP has another air-flow area at which the flow amount of the air is small, in addition to the small air-flow area in which the first stay member 210A is provided. The small air-flow area is such a part of the circular opening OP, at which the flow amount of the air is smaller than that of the specific part of the circular opening OP (the air-flow area P1 in FIG. 5). The air-flow area of the circular opening OP (P3 in FIG. 5), in which the first stay member 210A is provided, is most preferably selected as the small air-flow area at which the flow amount of the air is minimized, in view of suppressing the generation of the noise as much as possible.

In the present embodiment, each of the second stay members 2108 is inclined with respect to the radial direction in the circumferential direction (in the left-hand direction in FIG. 4) opposite to the inclined direction of the blade members 110 (in the right-hand direction in FIG. 4), when viewed them in the direction along the rotational center axis AX. However, the present embodiment may be modified in such a way that not all but some of the second stay members 2108 are inclined with respect to the radial direction in the circumferential direction opposite to the inclined direction of the blade members 110. In such a modification, each of the other second stay members 2108 is formed in such a way that it extends in the radial direction.

In the present embodiment, the shroud unit 200 is located at the position, which is the downstream side of the fan unit 100, that is, the rear side in the longitudinal direction of the automotive vehicle MV. The present embodiment may be modified in such a way that the shroud unit 200 is located at the position, which is an upstream side of the fan unit 100, that is, at the front side in the longitudinal direction of the automotive vehicle MV. In the case like the present embodiment, in which the shroud unit 200 is located at the downstream side of the fan unit 100, the pressure fluctuation between the blade members 110 and the stay members 210 becomes larger than that of the case in which the shroud unit 200 is provided at the upstream side of the fan unit 100. Therefore, the advantage of the present embodiment can be more effectively obtained.

Second Embodiment

A second embodiment will be explained. Hereinafter, those portions which are different from the first embodiment will be mainly explained, while the other portions the same or similar to the first embodiment will be omitted.

Figure 7:
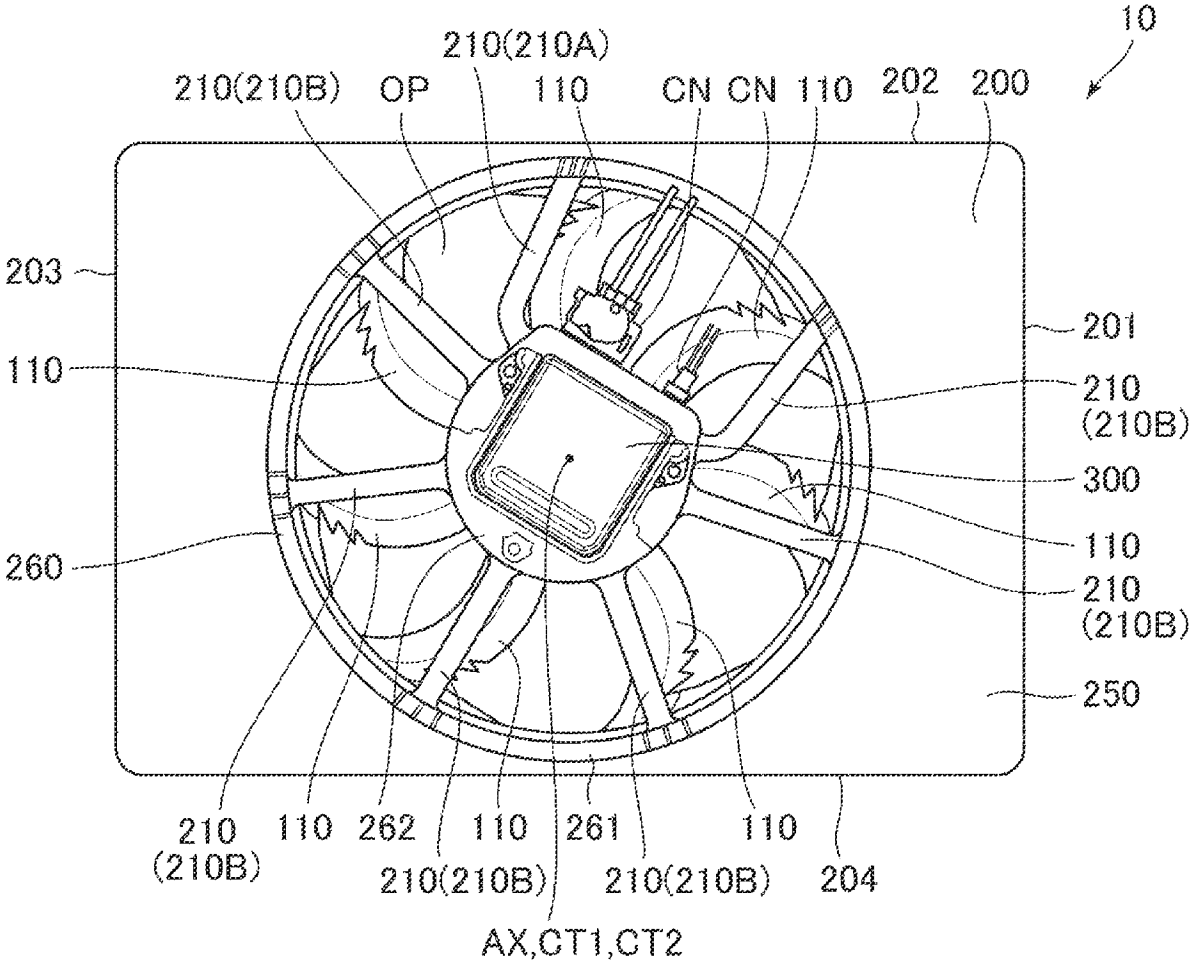
FIG. 7 is a schematic back-side view showing the fan device according to a second embodiment of the present disclosure.
Figure 8:
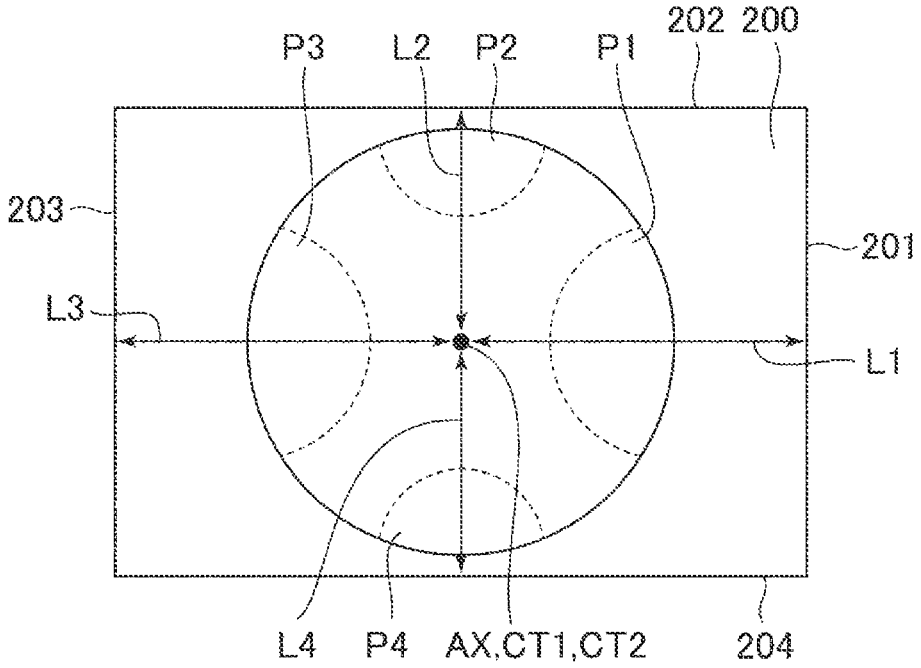
FIG. 8 is a schematic view showing the shroud unit and explaining flows of air flowing into the circular opening of the shroud unit.

FIG. 7 is a schematic back-side view showing the fan device 10 of the present embodiment, when viewed it from the rear side of the automotive vehicle MV in a similar manner to FIG. 2. FIG. 8 is a schematic view showing the shroud unit 200 of the present embodiment, in a similar manner to FIG. 5.

As shown in FIG. 8, in the present embodiment, the opening center CT1 of the circular opening OP and the shroud center CT2 of the shroud unit 200 coincide with each other, when viewed them in the direction along the rotational center axis AX. A distance L1 between the opening center CT1 of the circular opening OP and the right-hand side portion 201 is substantially equal to a distance L3 between the opening center CT1 of the circular opening OP and the left-hand side portion 203. In addition, a distance L2 between the opening center CT1 of the circular opening OP and the upper side portion 202 is substantially equal to a distance L4 between the opening center CT1 of the circular opening OP and the lower side portion 204.

Since the shroud unit 200 has a configuration of a horizontally-long shape, each of the upper side portion 202 and the lower side portion 204 is longer than the right-hand side portion 201 and the left-hand side portion 203. A distance between the opening center CT1 of the circular opening OP and an outer periphery of the shroud unit 200 becomes a minimum value in the vertical direction from the circular opening OP to the upper side portion 202 or to the lower side portion 204. An area of a part of the shroud unit 200, which is located in the above vertical direction and which is perpendicular to the air flow direction (the longitudinal direction of the automotive vehicle MV), in other words, the area formed between the outer periphery of the circular opening OP and the upper side portion 202 (or the lower side portion 204) becomes a minimum value. The flow amount of the air passing through the part of the circular opening OP located in the above vertical direction (that is, the air-flow area P2 or the air-flow area P4) becomes smaller.

In the present embodiment, the air-flow area P2 of the circular opening OP on the side of the upper side portion 202 or the air-flow area P4 of the circular opening OP on the side of the lower side portion 204 corresponds to the small flow-amount area. In the present embodiment, the small flow-amount area is formed in the direction, in which the distance between the opening center CT1 of the circular opening OP and the outer peripheral end of the shroud unit 200 becomes the minimum value. As shown in FIGS. 7 and 8, in the present embodiment, the first stay member 210A is provided in the air-flow area P2 of the circular opening OP, which is formed at the position close to the upper side portion 202. The same advantage to that of the first embodiment can be also obtained in the structure of the second embodiment.

As shown in FIG. 7, in the present embodiment, some of the second stay members 210B, for example, including the second stay member 210B extending in the direction to the left-hand side portion 203, are not inclined with respect to the radial direction in the circumferential direction but extending in the radial direction. The present embodiment may be modified in such a way that all of the second stay members 2108 are inclined with respect to the radial direction in the circumferential direction opposite to the inclined direction of the blade members 110, in the same manner to the first embodiment.

The present disclosure is explained with reference to the embodiments and/or modifications. However, the present disclosure is not limited to the above embodiments and/or modifications but can be further modified in various manners without departing from a spirit of the present disclosure.

What is claimed is:

1. A fan device for an automotive vehicle, comprising:

a fan unit located at a downstream side of a heat exchanger for the automotive vehicle in an air flow direction, and including a hub portion and multiple blade members, the hub portion having a center axis which is a rotational center axis of the fan unit, and each of the multiple blade members being formed to extend from an outer peripheral side surface of the hub portion in a radial outward direction and inclined toward a circumferential direction;

a shroud unit, which is formed of a plate-shaped member, is rectangularly shaped, having a horizontally-long shape, each of an upper side portion and a lower side portion is longer than a right-hand side portion and a left-hand side portion, and forms a circular opening to overlap with the fan unit in a direction along the rotational center axis, wherein the shroud unit has a shroud center located centrally in a left-right direction and in an up-down direction;

an electric motor for rotating the fan unit;

multiple stay members which extend from an outer periphery of the circular opening to the electric motor to support the electric motor in the circular opening; and an electric connector attached to and electrically connected to a side surface of the electric motor, wherein the circular opening has an opening center which is located at a position which is closer to the left-hand side portion than the shroud center in the horizontal direction;

the multiple stay members include a first stay member which is inclined, in the same circumferential direction as that of the blade members, and a plurality of second stay members inclined in an opposite circumferential direction to that of the blade members, and wherein the plurality of second stay members include one second stay member located on a side in a direction opposite to the rotational direction of the fan unit to the electric connector, the one first stay member and the one second stay member on both sides of the electric connector are symmetrically arranged, and wherein the one first stay member extends in a direction oblique to both the vertical direction and the horizontal direction so as to extend toward a left-upper corner portion of the shroud member, and wherein the electric connector is interposed between the first stay member and the one second stay member.

2. The fan device for an automotive vehicle according to claim 1, wherein the first stay member and the one second stay member on both sides of the electric connector partially extend in a parallel manner.

3. The fan device for an automotive vehicle according to claim 1, wherein the one first stay member extends along a first straight line which crosses the left-hand side portion of the shroud unit, and wherein the one second stay member extends along a second straight line which crosses the upper side portion of the shroud unit.

* * * * *